US005806732A

United States Patent [19]

Hensley

[11] Patent Number: 5,806,732

[45] Date of Patent: Sep. 15, 1998

[54] CALL LANYARD

[76] Inventor: James D. Hensley, 2305 Orchard La., White Bear, Minn. 55110

[21] Appl. No.: 766,300

[22] Filed: Dec. 13, 1996

[51] Int. Cl.[6] ..... A45F 3/14

[52] U.S. Cl. ..... 224/258; 224/250; 224/910; D2/635

[58] Field of Search ..... 224/258, 257, 224/250, 103, 921, 910; 24/3.4, 298, 302, 3.13; D22/134; D3/224, 254; 63/3, 3.2; 294/150, 154, 157, 149

[56] References Cited

U.S. PATENT DOCUMENTS

| | | | |
|---|---|---|---|
| 118,294 | 8/1871 | Stevens | 63/3.2 |
| 1,650,491 | 11/1927 | Calvert | 224/921 |
| 2,572,889 | 10/1951 | Strykower | 224/258 |
| 3,096,010 | 7/1963 | Rasmussen | 224/250 |
| 3,186,611 | 6/1965 | Sonderman | 224/258 |
| 4,321,804 | 3/1982 | Borofsky et al. | 63/3.2 |
| 4,327,850 | 5/1982 | Robinson, Jr. | 224/103 |
| 5,077,927 | 1/1992 | Derryberry | 224/103 |

FOREIGN PATENT DOCUMENTS

| | | | |
|---|---|---|---|
| 52 897 | 11/1911 | Germany | 294/154 |

*Primary Examiner*—Linda J. Sholl
*Attorney, Agent, or Firm*—Jacobson & Johnson

[57] ABSTRACT

An improved call holder lanyard comprising an elongated flexible cord having a first end, an intermediate section and a second end, with the first end having a first member thereon for slideably but resistantly engaging a portion of the intermediate section of the flexible cord to allow a hunter to slideably position the first member along the intermediate section and the second end having a second member thereon for slideably but resistantly engaging a further portion of the intermediate section of the flexible cord to allow a hunter to slideably position the second member along the intermediate section with the first end, the second end and the intermediate section coacting to form a loop sufficiently long for placement around a hunter's neck with the loop being contractable by sliding the members in a first direction along the intermediate section and expandable by sliding the members in a second direction along the intermediate section and a plurality of call-holder cords positioned along the call holder lanyard to inhibit entanglement of the call-holder cords.

9 Claims, 2 Drawing Sheets

CALL LANYARD

FIELD OF THE INVENTION

This invention relates generally to a call holder lanyard and, more particularly, to an improved call holder lanyard for geese calls, duck calls, and the like.

BACKGROUND OF THE INVENTION

The use of hunting calls to imitate the sound of a fowl such as a duck, goose or crow are well known in the art. Typically, the call comprises a mouthpiece, an outer hollow housing having a reed or the like that vibrates when a person blows into the mouthpiece. By blowing into the mouthpiece, a hunter can control the flow of air through the call and generate sounds that imitate a particular call of a fowl. To imitate different sounds of the fowl, a hunter can use a different call. For example, a hunter might have many different calls, with a specific call capable of imitating a particular sound, such as a distress call or a feeding call. A hunter might use a hunter call to attract the attention of the ducks and then use another call to bring the ducks in closer. As the opportunity to shoot can be relatively short, the hunter wants the calls readily available so that he or she can quickly use the calls and then put the call away so the hunter can assume the proper hunting posture.

One way of holding the calls is to form a loop that is sufficiently long to go around the neck of the user. The individual calls are then tied to the loop to enable the hunter to have the calls in a ready position a few inches from his or her mouth. The prior-art loop holder has been found to have shortcomings. One of the problems is that the loop holder may be too small for one hunter and too large for another hunter. When a hunter picks up one call, he or she picks up all the other calls as the calls are tied to the loop by a string or the like; this results in a problem.

Another problem is that the string that holds the calls to the neck loop become entangled as they hang suspended from a user's loop holder. The present invention provides an improved call holder that facilitates adjustment of the call holder for different sized people as well as call holder cords that keep the calls separate both during use and non-use.

SUMMARY OF THE INVENTION

Briefly, the invention comprises a call holder lanyard that has members which a hunter can slide along the lanyard to expand or contract the size of the lanyard, and a plurality of call holder cords extending from the lanyard, with the call holder cords spaced from each other on the call holder lanyard to inhibit the entanglement of the call holder cords during use of the call holder lanyard. The call holder cords are slideably adjustable to allow extension or retraction of the call holder cord to enable a hunter to position the calls for use.

DESCRIPTION OF THE PREFERRED EMBODIMENT

Figure 1:
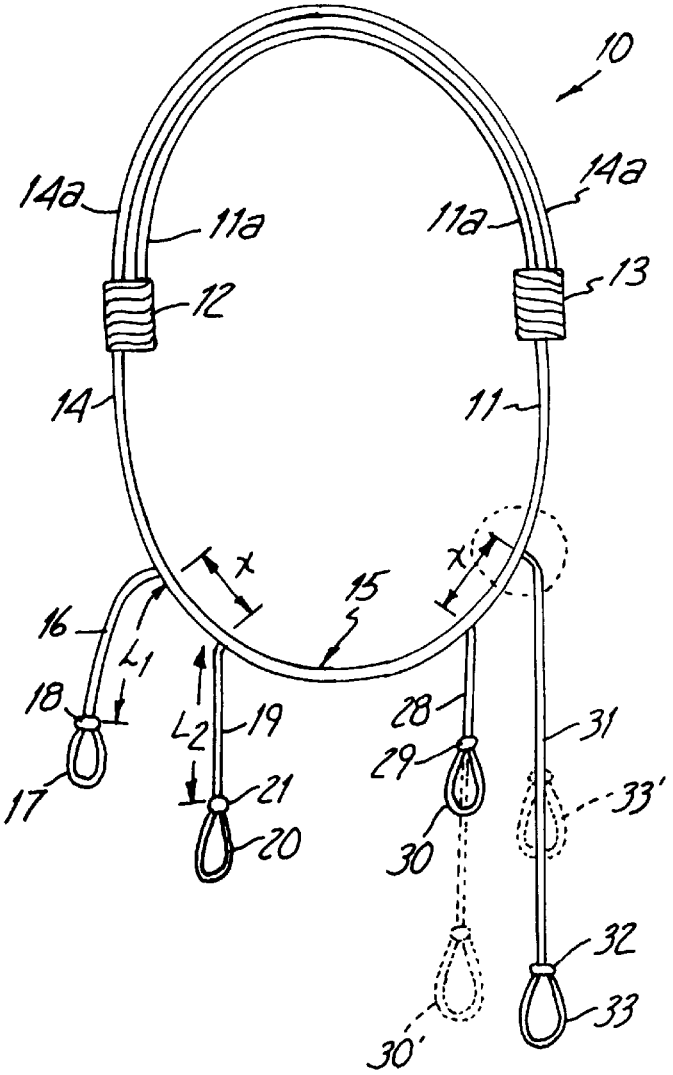
FIG. 1 is a front view of the call holder lanyard of the present invention with a plurality of call holders extending therefrom.

FIG. 1 shows a front view of call holder lanyard 10 of the present invention. Call holder lanyard 10 comprises an elongated, flexible, braided cord 15 arranged to form a lower single-cord section and an upper double-cord section. Lanyard 10 is normally worn around the neck of a hunter and hangs down like a necklace. The upper double-cord section of braided cord 15 is identified by reference numerals 11*a* and 14*a*, while the lower single-cord section of braided cord 15 is identified by reference numerals 11 and 14. In the preferred embodiment, cord 15 is formed by braiding a plurality of two or more separate cords together to form a single, braided cord.

Figure 3:
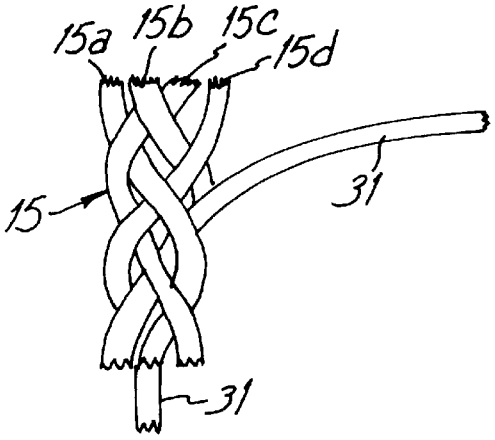
FIG. 3 is a front view of the call holder lanyard of FIG. 1 with the lanyard in an extended position for fitting around the head of a person with the lanyard including goose calls extending therefrom.

Typically, the individual cords used to form braided cord 15 are made from a flexible and durable material such as nylon or the like. FIG. 3 shows a detail of a portion 53 of braided cord 15, with braided cord 15 comprised of individual flexible cords 15*a*, 15*b*, 15*c* and 15*d* which are braided together to form a single braided cord 15. Located within the braided cord 15 but not braided thereto is a call-holder cord 31. Call-holder cord 15 is frictionally held in a central position within cord 15 by the individual cords 15*a*, 15*b*, 15*c* and 15*d* in the braided cord 15.

FIG. 1 shows that braided cord 15 is a single, continuous braided cord which has a first braided end 13 and a second braided end 12. Braided end 13 is formed around a portion of braided cord 15 and is illustrated in greater detail in FIG. 4. That is, braided end 13, which is a part of braided portion 14*a*, extends around the portion of braided cord 15 which extends through braided member 13 and is identified as cord 11 below braided end 13 and by 11*a*above braided end 13. The significance of the relationship of braided end 13 and braided cord 15 is that braided end 13 slideably but resistantly engages a portion of the intermediate section 15 of the braided, flexible cord to allow a hunter to slideably position the braided end 13 along braided cord 15 by pulling on braided end 13 and braided cord 15. Similarly, braided end 12 slideably but resistantly engages a portion of the intermediate section 15 of the braided flexible cord to allow a hunter to slideably position the braided end 12 along braided cord 15 by pulling on braided end 12 and braided cord 15.

The sliding of braided cord 15 within braided ends or members 12 and 13 allows a hunter to slideably position members 12 and 13 along the intermediate cord section with the first end, the second end, and the intermediate section coacting to form a loop of sufficient size to be comfortably fit around a hunter's neck with the loop being contractable in size by sliding the members in a first direction along the intermediate section and expandable in size by sliding the members in a second direction along the intermediate section. The braided members 12 and 13 provide sufficient frictional resistance so that the lanyard will retain its size under normal use.

FIG. 1 illustrates that call-holder cord 31 can be displaced with respect to cord holder 15 with dotted loop 33' showing the position of one end of call-holder cord 31 and dotted loop 30' showing the position of the opposite end of call cord after the call-holder cord is slid with respect to the braided cord 15. That is, the call-holder cord 31 is adjustable to permit the relative positioning of the calls with respect to the person wearing the call holder. This feature allows a hunter to locate a particular call closer or further from his or her mouth. By doing so, the hunter can position the calls in an organized manner so that he or she can select the call by the position the call holder occupies on the lanyard.

Figure 2:
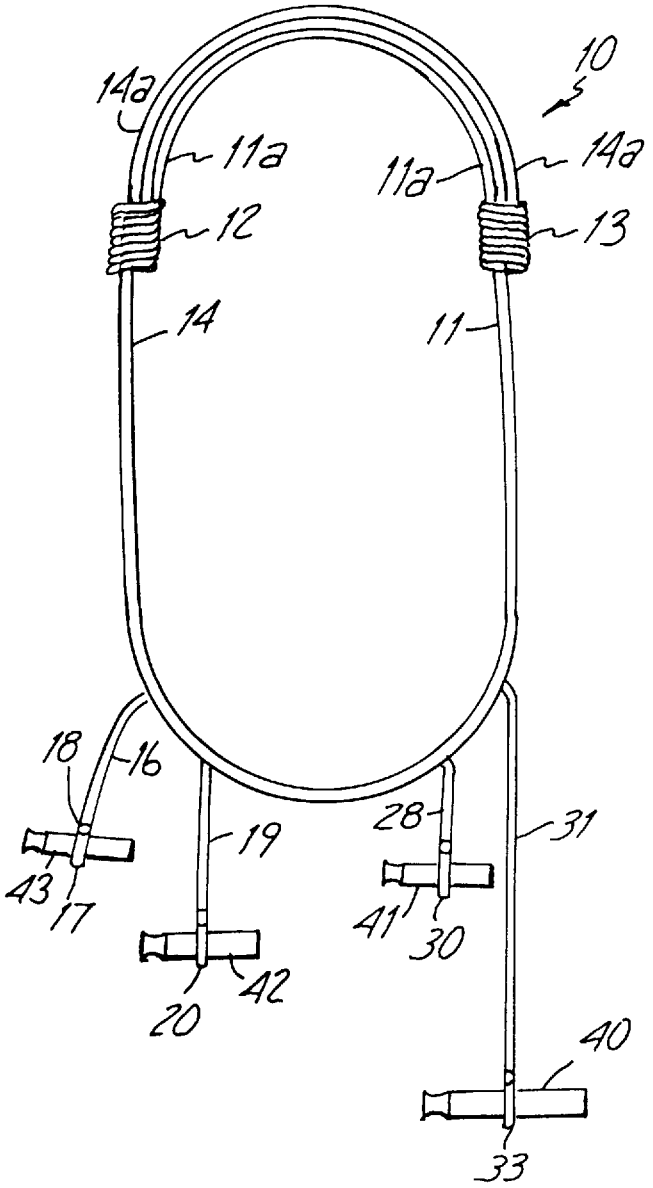
FIG. 2 is an enlarged view of portion of FIG. 1.
Figure 4:
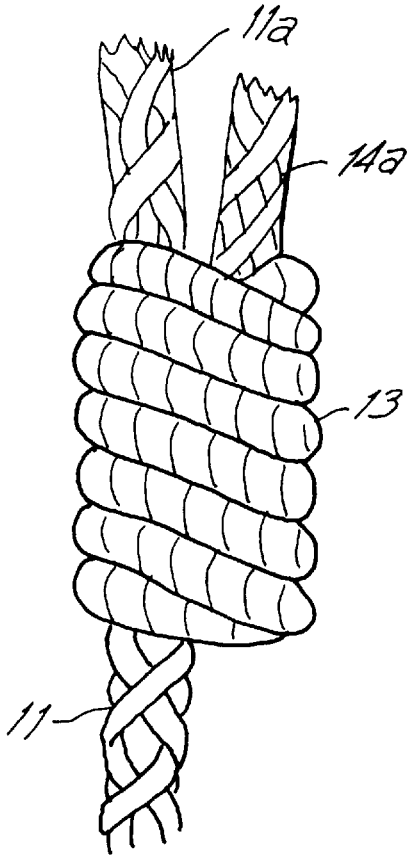
FIG. 4 is view of a portion of FIG. 2.

Thus, the invention comprises an improved call holder lanyard formed from an elongated flexible cord 15 having a first end member 13 and a second end member 12 with an intermediate section located therebetween. The first end member 12 slideably but resistantly engages a portion of the intermediate section of the flexible cord 15 to allow a person to slideably position the first member 12 along the intermediate section. Similarly, the second end member 13 slideably but resistantly engages a further portion of the intermediate section of the flexible cord 15 to allow a hunter to slideably position the second member 13 along the intermediate section to increase or decrease the size of the loop. FIG. 2 and FIG. 4 show the intermediate section coacting with the first end member 12 and the second end member to 13 form a loop of sufficient length to facilitate placement around a hunter's neck with the loop being contractable by sliding members 12 and 13 in a first direction along the intermediate section and expandable by sliding members 12 and 13 in a second direction along the intermediate section.

FIG. 1 shows that lanyard 15 includes a first call-holder cord 16 having a first end secured to flexible cord 15 at a first position with a second end with a loop 17 and slip knot 18 for securing a first call thereto and a second call-holder cord 19 having a first end secured to flexible cord 15 at a second position with a second end with a loop 20 and a slip knot 21 for securing a second call thereto. FIG. 1 shows the first end spaced from the second end a distance "x". The distance "x" is of sufficient length to inhibit the cords from entangling with one another. In most applications two- to three- inch spacing is sufficient. Similarly, lanyard 15 includes a third call-holder cord 28 having a first end secured to flexible cord 15 at a third position with a second end with a loop 30 and a slip knot 29 for securing a third call thereto and a fourth call-holder cord 31 having a first end secured to flexible cord 15 at a fourth position with a second end with a loop 33 and a slip knot 32 for securing a fourth call thereto.

FIG. 1 shows the push-pull arrangement of cord holders 28 and 31. That is, cord holders 28 and 31 are made from a single cord which extends through a portion of braided cord 15 and can be slid from one position to another by merely pulling one of the cord holders. Dotted loop 30' indicates that lengthening call holder cord attached to loop 30' shortens call holder cord attached to loop 33'.

FIG. 2 shows call holder lanyard 10 in an extended position with call 40 attached to call holder loop 33, call 41 attached to call holder loop 30, call 42 attached to call holder loop 22 and call 43 attached to call holder loop 17. Locating the calls in the spaced condition shown in FIG. 2, inhibits the calls and call-holder cords from entanglement by the spacing from one another. In addition the spacing allows the hunter to select the proper call without having to look at the call. For example, the hunter will know from his or her placement of calls that the distress call is on the left and next to it is a mating call.

FIG. 1 indicates that the length of call-holder cord 16 is designated by $L_1$ and the length of call-holder cord 19 is 12. In the preferred embodiment, lengths $L_1$ and $L_2$ are sufficiently long so that when the hunter raises a call to his or her mouth, the other calls remain in position. That is, one can pick up the calls independently of one another.

If the invention is made of braidable materials, such as nylon or the like, one can use a heat source to cut and seal the end of the braidable material within the braided end member. By cutting the end of the individual cords inside the braided ends leaves an end member with no unsightly protruding ends. FIG. 4 illustrates that the braided end is left with a smooth exterior by having the ends of the individual cords terminated within the braided end member.

I claim:

1. A call holder lanyard comprising:

an elongated flexible cord having a first end, a second end and an intermediate section therebetween, said first end having a first member thereon for slideably but resistantly engaging a portion of the intermediate section of said flexible cord to allow a hunter to slideably position said first member along said intermediate section, said second end having a second member thereon for slideably but resistantly engaging a further portion of the intermediate section of said flexible cord to allow a hunter to slideably position said second member along said intermediate section with said first end, said second end and said intermediate section coacting to form a loop of sufficient length for placement around a hunter's neck with said loop being contractable by sliding the members in a first direction along said intermediate section and expandable in size by sliding the members in a second direction along said intermediate section; and a first call-holder cord having a first end, a first intermediate portion and a second end, said first intermediate portion slidingly secured to said flexible cord at a first position with a to allow lengthening of said first end while shortening of said second end in a first position for use; and a second call-holder cord having a first end, a second intermediate portion and a second end, said second intermediate portion slidingly secured to said flexible cord at a second position with to allow lengthening of said first end while shortening of said second call-holder cord second end with said second position spaced sufficiently far from said first position to inhibit entanglement of said first and said second call holder cord.

2. The call holder lanyard of claim 1 wherein the elongated flexible cord comprises a plurality of braided cords.

3. The call holder lanyard of claim 1 wherein the first member and said second member encircle said intermediate section of said flexible cord.

4. The call holder lanyard of claim 2 wherein the first call-holder cord and the second call-holder cord are a continuous member.

5. The call holder lanyard of claim 1 including a third call-holder cord having a first end and an intermediate section slidingly secured to said flexible cord at a third position with a second end for securing a third call thereto; and a fourth call-holder cord having a first end and an intermediate section slidingly secured to said flexible cord at a fourth position with said fourth call-holder cord including a second end for securing a fourth call thereto with said third position spaced sufficiently far from said fourth position to inhibit entanglement of calls hanging therefrom.

6. The call holder lanyard of claim 5 wherein the third call-holder cord and the fourth call-holder cord are a continuous member.

7. The call holder lanyard of claim 1 including a slip knot on the second end of said first call holder and a slip knot on the second end of said second call holder.

8. The call holder lanyard of claim 1 wherein said first call-holder cord is of predetermined length and the distance of said call-holder cord extending from lanyard is adjustable by pulling on said cord holder cord while holding said call holder lanyard.

9. A call holder lanyard comprising:

an elongated flexible cord having a first end, a second end and an intermediate section therebetween;

a first member for engaging a portion of the intermediate section of said flexible cord to allow a hunter to position said first member along said intermediate section to form said elongated flexible cord into a sufficiently long loop to facilitate placement around a hunter's neck with said loop being contractable or expandable by repositioning the members along said intermediate section;

a first call-holder cord having a first end, an intermediate section slidingly secured to said flexible cord and a second end for securing a first call thereto to allow said first end of said first call-holder cord to be shortened while said second end of said first-call holder is lengthened; and a second call-holder cord having a first end secured to said flexible cord and a second end for securing a second call thereto with said second call-holder cord spaced sufficiently far from said first call-holder cord to inhibit entanglement of the call-holder cords when the lanyard is located around a user's neck.

* * * * *